United States Patent [19]

Horney

[11] 4,407,187

[45] Oct. 4, 1983

[54] AIR CONTROL DEVICE

[76] Inventor: Robert W. Horney, 2402 Maple Rd., Corinth, Miss. 38834

[21] Appl. No.: 330,964

[22] Filed: Dec. 15, 1981

[51] Int. Cl.[3] ..... F24F 13/12

[52] U.S. Cl. ..... 98/41 SV; 98/101; 98/114

[58] Field of Search ..... 98/41 SV, 101, 114, 98/40 V, 40 N

[56] References Cited

U.S. PATENT DOCUMENTS

| | | | |
|---|---|---|---|
| 766,957 | 8/1904 | Lloyd | 98/101 |
| 2,525,371 | 10/1950 | Reynolds, Jr. | 98/41 SV |
| 2,995,079 | 8/1961 | Fontaine | 98/101 |
| 3,046,719 | 7/1962 | Tropiano | 98/114 X |
| 3,073,525 | 1/1963 | Cislo | 98/41 SV |
| 3,306,178 | 2/1967 | Marino | 98/114 X |
| 3,986,850 | 10/1976 | Wilcox | 98/41 SV |

FOREIGN PATENT DOCUMENTS

| | | | |
|---|---|---|---|
| 887183 | 1/1962 | United Kingdom | 98/101 |
| 1210654 | 10/1970 | United Kingdom . | |

*Primary Examiner*—Albert J. Makay
*Assistant Examiner*—Harold Joyce
*Attorney, Agent, or Firm*—Walker & McKenzie

[57] ABSTRACT

A device for use in conjunction with an air flow duct to control the flow of air through the duct. The device includes a body for being secured with respect to the duct and having a central aperture therethrough for allowing substantially unhampered flow of air from the duct therethrough, a stationary plate for covering the central aperture of the body and having a plurality of apertures therethrough for allowing substantially unhampered flow of air therethrough, and a movable plate for covering the stationary plate and having a plurality of apertures therethrough for selective alignment with the apertures through the stationary plate to allow metering of the flow of air therethrough.

4 Claims, 6 Drawing Figures

AIR CONTROL DEVICE

BACKGROUND OF THE INVENTION

1. Field of the Invention

The present invention relates to devices for use in controlling the flow of air through a forced air system and the like.

2. Description of the Prior Art

Heretofore, various devices have been developed to aid in the control of air through the air flow duct of a forced air heating and cooling system and the like. Such prior art air control devices include damper-like baffles inserted in various sections of the air flow ducts in order to attempt to balance the flow of air throughout the entire duct network, and grill-like air registers located at the outlet end of each air flow duct to attempt to control the amount of and direction of air flow from the outlet end of each duct. Kennedy, U.S. Pat. No. 2,821,898, discloses such a typical prior art grill-like air registers. Lloyd, U.S. Pat. No. 766,957; Hoach, U.S. Pat. No. 2,437,741; Burwen, U.S. Pat. No. 2,792,771; Burgler, U.S. Pat. No. 2,976,795; and Fontaine, U.S. Pat. No. 2,995,079 disclose various type air registers and the like. None of the above described prior art, etc., discloses or suggests the present invention.

SUMMARY OF THE INVENTION

The present invention is directed towards providing an improved device for controlling the flow of air through air flow ducts. The concept of the present invention is to provide means that will positively meter the flow of air through an air flow duct or the like.

The air control device of the present invention includes, in general, a body means for being attached to an air flow duct, a face plate means for being attached to the body means and for covering the air passageway through the air flow duct, the face plate means having a plurality of apertures therethrough for allowing substantially unrestricted flow of air through the air passageway of the air flow duct, and a meter plate means for being movably secured with respect to the face plate means and for metering the flow of air through the face plate means, the meter plate means having a plurality of apertures therethrough and being movable between a fully opened position in which apertures therethrough are fully aligned with the apertures through the face plate means to allow substantially unrestricted flow of air through the air flow duct and a fully closed position in which the apertures therethrough are fully out-of-align with the apertures through the face plate means to prevent any flow of air through the air flow duct.

DESCRIPTION OF THE PREFERRED EMBODIMENT

The air control device 11 of the present invention is for use in conjunction with an air flow duct D having an air passageway P therethrough. The air passageway P of the air flow duct D is defined by an inner wall W. The air flow duct D may be of various configurations. For exammple, the air flow duct D may be one of the various air flow ducts in a central forced air heating and cooling system in which the various air flow ducts have outlet ends O opening into a room of a house, building or the like whereby air from a central air heating or cooling unit can be directed to that room. The air control device 11 may be placed over the outlet end O of the air flow duct D to control the flow of air from the air flow duct D directly into the room (see FIG. 2). The air control device 11 may be associated with the wall, ceiling or floor of the room as will be apparent to those skilled in the art. On the other hand, the air control device 11 may be placed within the ducts D at various locations between the air heating or cooling unit and the outlet ends O of the ducts D (not shown) to replace the typical baffles used to balance the flow of air therethrough for reasons apparent to those skilled in the art. Further, the air control device 11 could be placed with the flue of a chimney (not shown) to replace the typical damper used to control the flow of air therethrough.

Figure 1:
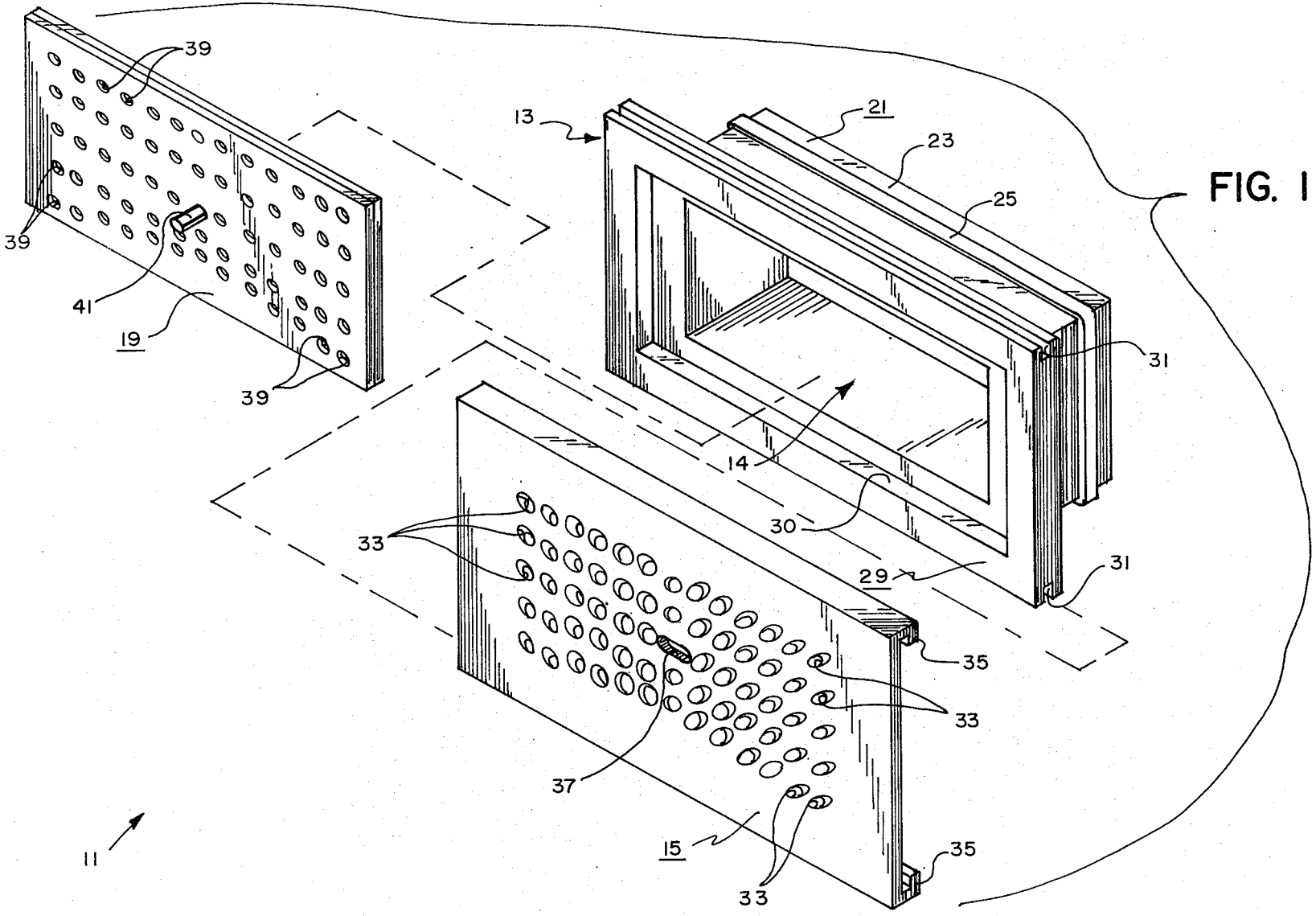
FIG. 1 is an exploded perspective view of the preferred embodiment of the air control device of the present invention.
Figure 2:
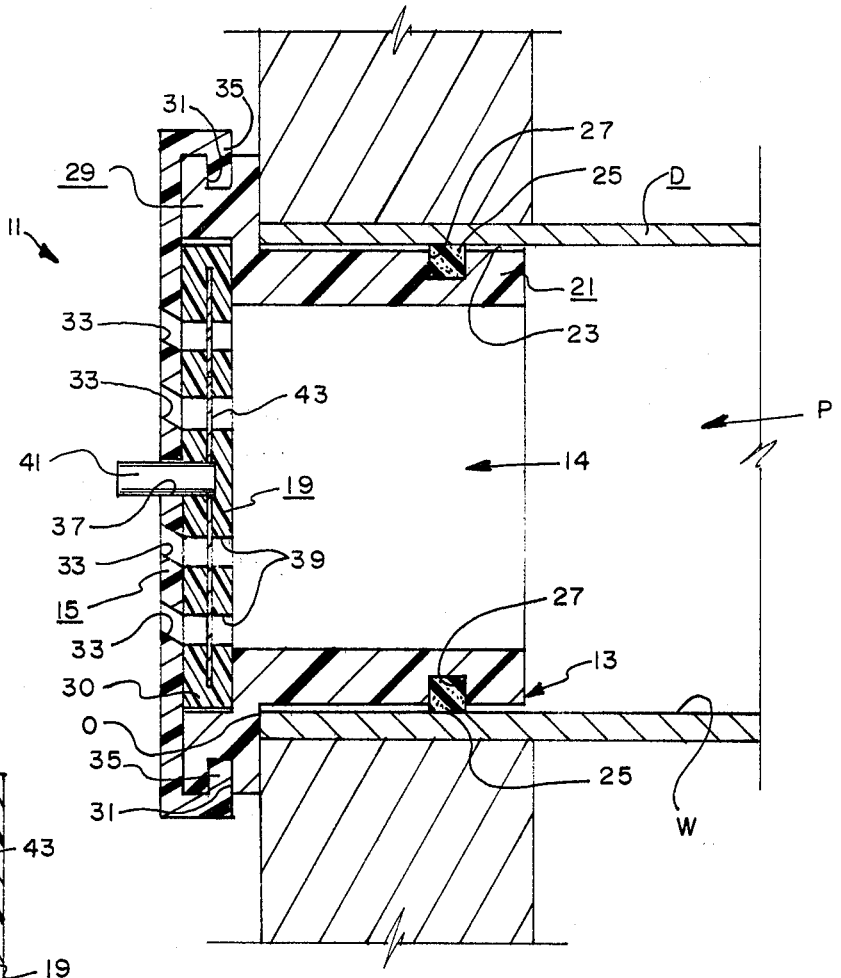
FIG. 2 is a sectional view thereof showing the device in conjunction with an air flow duct.
Figure 3:
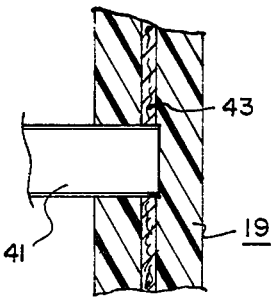
FIG. 3 is an enlarged sectional view of a portion thereof.

The preferred embodiment of the air control device 11 shown in FIGS. 1, 2 and 3 includes, in general, a body means 13 for being attached to the outlet end O of the air flow duct D and having an air passageway 14 therethrough, a face plate means 15 for being attached to the body means 13, and a meter plate means 19 for being movably secured with respect to the face plate means 15.

The body means 13 includes a neck member 21 for being positioned within the air passageway P through the air flow duct D. The neck member 21 has an outer wall 23 for being positioned adjacent the inner wall W of the air flow duct D. The device 11 may include insulation means 25 such as a strip of foam rubber or the like for being positioned between the outer wall 23 of the neck member 21 and the inner wall W of the air flow duct D when the body means is attached to the outlet end O of the air flow duct D (see FIG. 2) to prevent any flow of air between the outer wall 23 of the neck member 21 and the inner wall W of the air flow duct D. A groove 27 (see FIG. 2) is preferably provided around the outer periphery of the neck member 21 for receiving a portion of the insulation means 25. The insulation means 25 may be fixedly attached to the neck member 21 in the groove 27 by way of glue or the like. The body member 13 preferably has a flange member 29 attached to the outer end of the neck member 21 for being positioned against the outer end O of the air flow duct D and abutting against the wall, floor or ceiling. The flange member 29 preferably has a depressed portion 30 about the air passageway 14 for receiving the meter plate means 19 and preferably has grooves 31 at least in the upper and lower edges thereof for receiving a portion of the face plate means 15. The body means 13 may be constructed in any manner apparent to those skilled in the art. For example, the neck member 21 and flange member 29 may be integrally molded of a plastic or the like in any manner apparent to those skilled in the art.

The face plate means 15 consist substantially of a plate for being attached to the flange member 29 of the body means 13 to cover the air passageway 14 through the body means 13. The face plate means 15 has a plurality of orifices or apertures 33 therethrough for allowing substantially unhampered flow of air from the air passageway 14. Various ones of the apertures 33 may be angled to direct the flow of air therethrough in various manners. For example, various ones of the apertures 33 may be directed outward and downward at a compound angle to direct flow from the air control device 11 outward and downward. The face plate means 15 is intended to be stationarily attached to the body means 13 in any manner apparent to those skilled in the art. However, it is intended that the face plate means 15 be easily removable from the body means 13 to allow face plate means 15 of different colors, air flow characteristics, etc., to be easily attached to the body means 13. Thus, the face plate means 15 may be provided with hook-like channels 35 on its upper and lower edges to engage the grooves 31 in the upper and lower edges of the flange member 29 whereby the face plate means 15 can be merely slid onto the flange member 29 of the body means 13. The face plate means 15 preferably has an elongated slot 37 therein for reasons which will hereinafter become apparent. The specific construction of the face plate means 15 may vary. For example, the face plate means 15 may be molded of a plastic material in any manner apparent to those skilled in the art.

Figure 4:
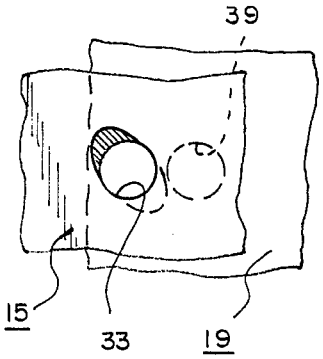
FIG. 4 is a front elevational view of a portion thereof.
Figure 5:
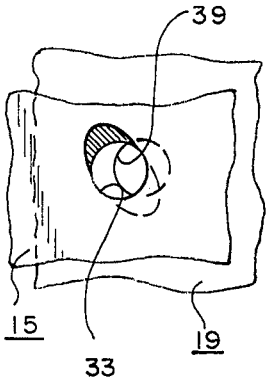
FIG. 5 is a front elevational view similar to FIG. 4 but with a portion thereof in a moved position.
Figure 6:
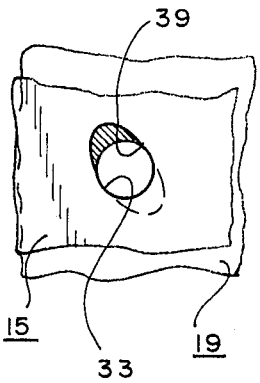
FIG. 6 is a front elevational view thereof similar to FIGS. 4 and 5 but with a portion thereof in a moved position

The meter plate means 19 is adapted to be movably secured with respect to the face plate means 15 to meter, or control, the flow of air through the face plate means 15. The meter plate means 19 has a plurality of orifices or apertures 39 therethrough for being selectively aligned with the apertures 33 through the face plate means 15 whereby air can flow through the air control device 11 substantially unhindered. The meter plate means 19 is located within the depressed 30 in the flange member 29. The relative size of the meter plate means 19 and the depression 30 is such that the meter plate means 19 can be moved back and forth within the depression 30 whereby the apertures 39 can move in and out of alignment the apertures 33. Thus, the meter plate means 19 can be moved from a fully closed position in which the apertures 30 are completely out of alignment with the apertures 33 (see FIG. 4) to a partially opened position in which the apertures 39 are partially aligned with the apertures 33 (see FIG. 5) and to a fully opened position in which the apertures 39 are fully aligned with the apertures 33 (see FIG. 6). A handle-like member 41 may extend through the slot 37 in the face plate means 15 and be secured to the meter plate means 19 for allowing the meter plate means 19 to be easily moved with respect to the face plate means 15 (Note: the handle-like member 41 is preferably removable from the meter plate means 19 to allow easy assembly-disassembly of the face plate means 15 and meter plate means 19 relative to the body means 13. Thus, for example, the handle-like member 41 may be merely press-fitted to the meter plate means 19 whereby it can be merely pulled therefrom when it is desired to assemble or disassemble the device 11.). The meter plate means 19 may be constructed in any manner apparent to those skilled in the art. For example, the meter plate means 19 may be molded from a plastic material.

The air control device 11 may include filter means 43 for filtering the air passing through the air flow duct D. The filter means 43 may consist of any typical filter media such as spun polyester, etc. The filter means 43 may be fixedly attached to the meter plate means 19. More specifically, the filter means 43 may be encased within the meter plate means 19 (see FIGS. 2 and 3) during the manufacture thereof. The filter means 43 may be reusable or may be of the disposable type.

The use of the air control device 11 is quite simple. The body means 13 is mounted on the outlet end O of an air flow duct D in any manner apparent to those skilled in the art. It should be noted that the air flow duct D may be of substantially square, substantially rectangular, or round cross-sectional shape and the air control device 11 may be of a shape to correspond therewith. Additionally, the outlet end O of the air control duct D may be a wall outlet, a ceiling outlet, or a floor outlet as will be apparent to those skilled in the art. Once the body means 13 has been attached to the air flow duct D, the face plate means 15 and meter plate means 19 are mounted on the body means 13. The meter plate means 19 can then be moved with respect to the face plate means 15 to control the amount of air passing through the air control device 11.

Although the invention has been described and illustrated with respect to preferred embodiments thereof and preferred uses therefore, it is not to be so limited since changes and modifications can be made therein which are within the full intended scope of the invention.

I claim:

1. An air control device for use in conjunction with the air passageway of an air flow duct to control the flow of air therethrough, said air control device comprising:

(a) a stationary plate means for being attached to said air flow duct transverse of said air passageway, said stationary plate means having a substantially flat face and a plurality of circular apertures therethrough, the longitudinal axes of said apertures being at an oblique angle with respect to said face; and (b) a movable plate means for covering said plurality of apertures of said stationary plate means, said movable plate means having a substantially flat face and a plurality of circular apertures therethrough and being movable between a first position in which said plurality of apertures through said movable plate means are fully out-of-alignment with said plurality of apertures through said stationary plate means and a second position in which said plurality of apertures through said movable plate means are fully aligned with said plurality of apertures through said stationary plate means, the longitudinal axes of said apertures being at a right angle with respect to said face.

2. An air control device for placement over the outlet end of an air flow duct in a forced air system to control the flow of air from said air flow duct into a room, said air flow duct having an inner wall for defining an air passageway; said air control device comprising:

(a) body means for being attached to said outlet end of said air flow duct, said body means including a neck member for being positioned within said air passageway, said neck member having an outer wall, said neck member having an aperture therethrough for allowing substantialy unhampered flow of air from said air flow duct;

(b) face plate means for being removably attached to said body means and for covering said air passageway through said body means, said face plate means having a substantially flat face and a plurality of circular orifices therethrough for allowing substantially unrestricted flow of air from said air flow duct into said room, the longitudinal axes of said orifices through said face plate means being at an oblique angle with respect to said face so as to provide an optimum direction of flow of air from said air flow duct into said room;

(c) meter plate means for being movably secured with respect to said face plate means and for metering the flow of air through said face plate means, said meter plate means having a substantially flat face and a plurality of circular orifices therethrough, said meter plate means being movable between a fully opened position in which said orifices through said meter plate means are fully aligned with said orifices through said face plate means to allow substantially unrestricted flow of air from said air flow duct into said foom and a fully closed position in which said orifices through sand meter plate means are fully out of align with said orifices through said plate means to prevent any flow of air from said air flow duct into said room and a plurality of intermediate positions in which said orifices through said meter plate means are partially aligned with said orifices through said face plate means to allow varying amount of air flow from said air flow duct into said room, the longitudinal axes of said orifices being at a right angle with respect to said face; and (d) filter means attached to said meter plate means for filtering the air passing from said air flow duct into said room.

3. The air control device of claim 2 in which is included insulation means for being positioned between said inner wall of said air flow duct and said outer wall of said neck member of said body means to prevent any flow of air between said inner wall of said air flow duct and said outer wall of said neck member of said body means.

4. The air control device of claim 3 in which said neck member of said body means has a groove for receiving a portion of said insulating means.

* * * * *